United States Patent [19]

Naka et al.

[11] 4,318,951

[45] Mar. 9, 1982

[54] STAIR MAT

[76] Inventors: Hiromitsu Naka; Takeshi Miyashiro; Yoshihide Sugimoto, all of c/o Tokyo Kenkyusho of Kabushiki Kaisha Naka Gijutsu Kenkyusho, No. 39, Oaza Shinmachi, Yashio-shi, Saitama-ken, Japan

[21] Appl. No.: 107,623

[22] Filed: Dec. 27, 1979

[30] Foreign Application Priority Data

Dec. 28, 1978 [JP] Japan ..... 53-181115[U]
Dec. 28, 1978 [JP] Japan ..... 53-181116[U]

[51] Int. Cl.[3] ..... B32B 7/02; B32B 3/26; B32B 3/30

[52] U.S. Cl. ..... 428/167; 428/188; 428/192; 428/212; 428/217; 428/218; 52/179; 52/288

[58] Field of Search ..... 52/179, 188, 288, 821, 52/830; 428/121, 188, 212, 217, 192, 167, 218

[56] References Cited

U.S. PATENT DOCUMENTS 2,237,224 4/1941 Herschmann ..... 52/179
2,288,470 6/1942 Lorraine ..... 52/822 X
3,287,867 11/1966 Aton ..... 52/179
4,151,320 4/1979 Naka ..... 428/188 X

FOREIGN PATENT DOCUMENTS 761150 6/1967 Canada ..... 52/179
2122623 11/1972 Fed. Rep. of Germany ..... 52/179
165744 12/1933 Switzerland ..... 52/179

*Primary Examiner*—George F. Lesmes
*Assistant Examiner*—Alexander S. Thomas
*Attorney, Agent, or Firm*—Wenderoth, Lind & Ponack

[57] ABSTRACT

The invention relates to the installation of stair mats on stairs in a manner such that the edge cover is formed of a flexible synthetic resin or flexible rubber and a tread mat are adapted to the stairs, being adjacent to each other; the front edge of the tread mat being set on a tread side fixing tongue of the edge cover and the front edge of the tread mat being fixed on the tread side fixing tongue of the edge cover by an adhesive or by stitching.

A thin tread side fixing tongue is integrally and horizontally extended from the rear portion of an edge bead cushion of the edge cover.

2 Claims, 7 Drawing Figures

STAIR MAT

BACKGROUND OF THE INVENTION

This invention relates to a stair mat adapted to be installed on stairs, especially stairs arranged on the inside of a building.

In general, stair nosings are installed on the edge of steps for the purpose of preventing of one from missing his or her footing on the stairs. Also, carpeting is usually applied to the stairs for aesthetic and a sound absorption, purposes as well as for its buffer action, thermal insulation and flexibility. The carpeting is ordinarily fixed by stair rods.

Each tread of the stairs is generally covered with a piece of a carpet. In this case, at the time of going up and down the stairs, the front edge of the step is the most dangerous portion because it is slippery, and is apt to cause serious injury because of the propensity to stumble and fall. Moreover, the forward edge of the carpet tends to break easily as against the other portion of the carpet, and the forward edge of the carpet can be partially torn off, and may cause stumbling, since the front edge of the step is located lower than rest of the carpet.

However, in the case of installing only stair nosings, the sound absorption, the thermal insulation and the flexibility are lacking on the steps and the buffer action is insufficient. However, in the case of installing only carpets, the carpets are worn away at the edge of the steps, must be changed frequently and tend to become dirty quickly. This is, of course, uneconomical, and therefore; the stair nosing and the narrow carpet are connected in one united body, or are combined and separately and installed on the steps. However, the former integral body is econmical when either the stair nosing or the carpet is worn away or damaged and it is difficult to replace such unit. On the other hand, the latter type units cannot be easily installed. Moreover, the latter type unit bring into existence the problem of undesirable dispersion, because it must be installed in a manner such that the stair nosing and the carpet are put side by side or one above the other when a nail or a screw is driven into the carpet.

SUMMARY OF THE INVENTION

Therefore, one object of the present invention is to provide a stair mat which can prevent one from missing his or her footing on the stairs. This is accomplished by covering the edge of the stair with a nonskid and cushioning material, having sound absorption, and thermal insulation properties as well as flexibility and aesthetic properties.

Another object of the present invention is to provide a stair mat which can be easily installed on each of the steps, which is clear of the undesirable dispersion, and can be fixed firmly on the tread of the step. According to this exfoliation at the front portion of the step is prevented, and injury, due to stumbling is minimized.

BRIEF DESCRIPTION OF THE DRAWINGS

The above and other objects and attendant advantages of the present invention will be more readily apparent to those skilled in the art from the following description when read in connection with the accompanying drawings, in which.

DETAILED DESCRIPTION OF THE INVENTION

Figure 1:
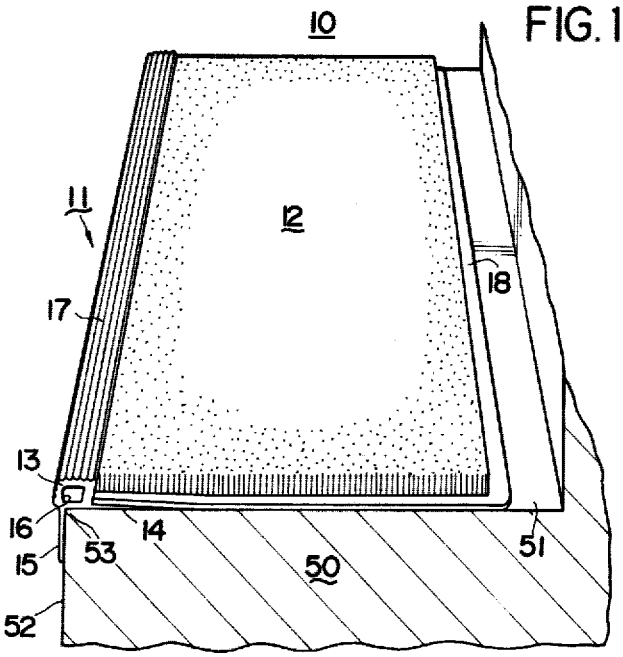
FIG. 1 is a perspective view of a preferred embodiment of a stair mat installed on the stairs of a building.
Figure 2:
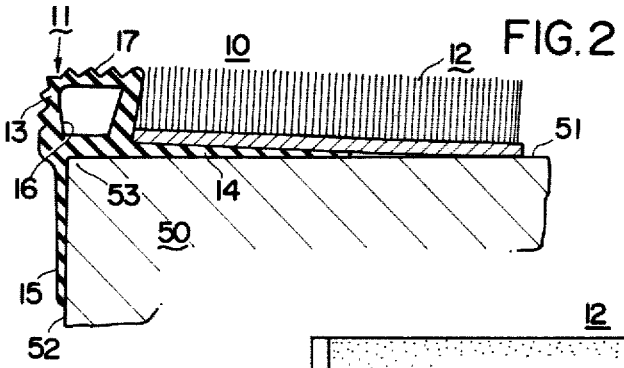
FIG. 2 is a fragmentary cross-sectional view of the embodiment of the stair mat as shown in FIG. 1.

The present invention will be now described referring to the accompanying drawings and more particularly, to FIGS. 1 to 4 in which the first embodiment of the stair mat constructed in accordance with the present invention is shown. The stair mat is generally shown with reference numeral 10 and installed on the stairs 50 of a building.

The stair mat 10 includes an edge cover 11 and a tread mat 12, which is installed on the tread 51 of the stairs 50, connecting each other.

The edge cover 11 may be produced from a flexible synthetic resin, a flexible rubber, or the like, which comprises an edge bead cushion 13, a thin tread side fixing tongue 14 and a thin riser side fixing tongue 15.

The edge bead cushion 13 is provided with a hollow portion 16 in a longitudinal direction so as to form a flexible tube, which is given a similar elasticity as the tread mat 12.

And the edge bead cushion 13 is provided with a non-skid top surface portion 17 on the upper surface, such as serrations on its cross-section, which heightens the non-skid effect.

The tread side fixing tongue 14 is integrally and horizontally extended from the rear side lower portion of the edge bead cushion 13, which is made thin. Needless to say, owing to the tread side fixing tongue 14, the edge bead cushion 13 can be fixed firmly on the tread 51 of the step 50, and which moderates the difference in grade between the upper surface of the tread 51 and the tread mat 12 adhering to the front edge of the tread mat 12 on the upper surface of the tread side fixing tongue 14.

The riser side fixing tongue 15 is designed to be thin and is integrally and vertically located at the front side lower portion of the edge bead cushion 13. The riser side of the fixing tongue 15 prevents warping of the edge cover 11 against the tread 52 when the riser side fixing tongue 15 is adhered on the riser 52 of the step.

Figure 3:
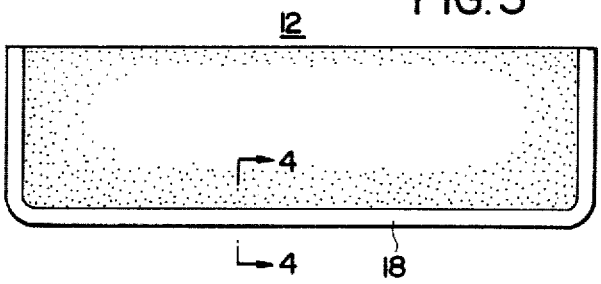
FIG. 3 is a plane view of the embodiment of the stair mat as shown in FIG. 1.
Figure 4:
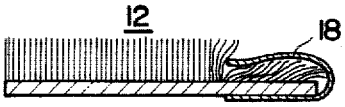
FIG. 4 is a cross-sectional view taken along substantially the line 4—4 of FIG. 3.

The tread mat 12 is made of a carpet, which is covered at the fringes excepting the forward edge with a cloth, a plastic sheet 18, or the like as shown in FIGS. 3 and 4, and which is previously kept at its fringes with a corner bead so as to prevent frying.

The tread mat 12 is made by cutting a carpet or preferably a rolled carpet strip into various shapes, for example, a rectangle, a half elliptical shape, a trapezoid, etc. Such tread mat 12 may be made by cutting a sheet of a felt, a mat or the like.

The tread mat 12 is adhered on the tread side fixing tongue 14 so as to connect with the rear portion of the edge bead cushion 13, or the tread mat 12 and the tread side fixing tongue 14 are stitched together.

In the installation of the stair mat 10 comprised as above-mentioned on the stairs 50 of a building, first of all the edge cover 11 is fixed on the forward edge 53 of the step 50; an adhesive agent is applied on the under surfaces of the edge bead cushion 13 and the tread side fixing tongue 14 and the rear surface of the riser side fixing tongue 15. The riser side fixing tongue 15 is set on the riser 52 of the step 50, at the same time the edge bead cushion 13 and the tread side fixing tongue 15 are pressed on the tread 51, then the riser side fixing tongue 15 is pressed on the riser 52.

After the edge cover 11 is fixed on the forward edge 53 of the step 50 as above-mentioned, an adhesive agent, an adhesive tape or the like is applied on the tread side fixing tongue 14, and the front edge of the tread mat 12 is adhered on the tread side fixing tongue 14, being adjacent to the rear portion of the edge bead cushion 13.

Then the tread mat 12 is fixed on the tread 51 of the step 50 by applying an adhesive agent on the under surface of the tread mat 12 or by using a suitable fastener.

In the above-mentioned installation of the stair mat 10, it is described that the tread mat 12 is adhered on the tread side fixing tongue 14 of the edge cover 11, already fixed on the forward edge 53 of the step 50, however, the tread mat 12 and the edge cover 11 may be previously connected together by adhering the tread mat 12 on the tread side fixing tongue 14 of the edge cover 11 or by stitching the tread mat 12 and the tread side fixing tongue 14.

Figure 5:
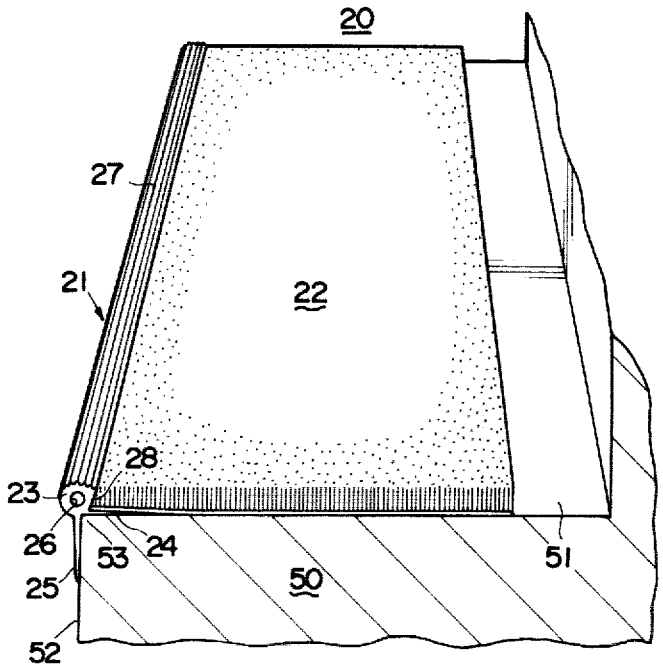
FIG. 5 is a perspective view of a modified embodiment of the stair mat installed on the stairs of a building.
Figure 6:
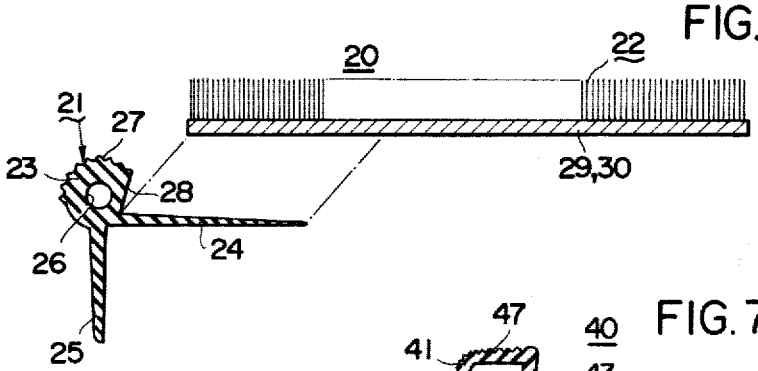
FIG. 6 is a fragmentary deal cross-sectional view of the stair mat as shown in FIG. 5.

FIGS. 5 and 6 show a modified embodiment 20 of a stair mat of the present invention, which is installed on the stairs 50 of a building.

The stair mat 20 includes an edge cover 21 being produced from a flexible synthetic resin, a flexible rubber, or the like and a tread mat 22, which is installed on the tread 51 of the step 50, connecting each other.

The edge cover 21 consists of an edge bead cushion 23, a thin tread side fixing tongue 24 and a thin riser side fixing tongue 25, which are integrally made from a flexible synthetic resin.

The edge bead cushion 23 is round and its cross-section, provided with a hollow 26 in a longitudinal direction so as to form a flexible tube. The edge bead cushion 23 is provided with a non-skid top surface portion 27 on the around surface, such as serrations on its cross-section, and is provided with an inclined abutment surface 28 at the rear side.

The thin tread side fixing tongue 24 is integrally and horizontally extended from the lower portion of the inclined abutment surface 28 of the edge bead cushion 23. The riser side fixing tongue 25 is integrally and vertically extended from the lower portion of the edge bead cushion 23, which may cover the forward edge 53 of the step 50 in cooperation with the tread side fixing tongue 24.

In general, the edge cover 21 is produced from a widely used resin, for example a polyvinyl chloride resin. However in order to maintain a lasting quality against footing pressure and wear, the edge cover 21 is preferably produced from a material which has wear resistance and flexibility, for example a urethane resin.

The tread mat 22 is made of a carpet provided with a base cloth 29 of the cloth formed of hemp, polypropylene or the like, and by various methods the pile is set on the base cloth 29 or the pile is attached onto the base cloth 30 of the synthetic resin by fusion.

In the installation of the stair mat 20, the edge cover 21 and the tread mat 22 as afore-mentioned, the stair mat 20 is installed on the stairs 50 in the same way as the afore-mentioned stair mat 10.

Figure 7:
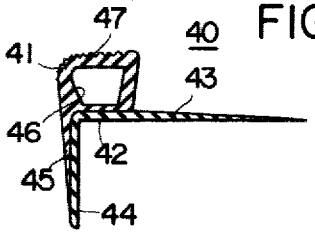
FIG. 7 is a cross-sectional view of a modification of an edge cover of the stair mat of the present invention.

FIG. 7 shows a modification 40 of an edge cover so as to adapt to the stair mat of the present invention.

The edge cover 40 is one in which the edge covers 11 and 21 of the above-mentioned stair mats 10 and 20, the tread side fixing tongue 14, 24, and the riser side fixing tongue 15, 25 are produced from a semi-rigid or rigid synthetic resin. The edge cover 40 comprises an edge bead cushion 41 produced from a flexible synthetic resin; an edge base 42 produced from a rigid synthetic resin, which is integrally set on the under surface of the edge bead cushion 41; a tread side fixing tongue 43 produced from a rigid synthetic resin, which is integrally and horizontally extended from the rear edge of the edge base 42; a riser side fixing tongue 44 being produced from the rigid synthetic resin, which is integrally and downwardly extended from the front edge of the edge base 42; and a shield tongue 45 being produced from the flexible synthetic resin, which is integrally extended from the front side of the edge bead cushion 41 and is integrally set on the front surface of the riser side fixing tongue 44 so as to cover the riser side fixing tongue 44.

The edge bead cushion 41 is provided with a hollow portion 46 in a longitudinal direction so as to form a flexible tube, and which is provided with a non-skid top surface portion 47 on the front surface and the upper surface having serrations along its cross-section.

Since the edge cover 40 is comprised as above-mentioned, the edge base 42 gives provides stiffness without losing the flexibility and cushioning, and which prevents deformation when walked upon. Further, the edge cover 40 can be easily and firmly installed on the stairs 50 by an adhesive tape.

Owing to the stair mat 10 and 20, which the front edge of the tread mat 12, 22 is fixed on the tread side fixing tongue 14, 24, 43 of the edge cover 11, 21, 40, being connected each other. Thus, the exfoliation of the tread mat 12, and 22 can be prevented, and tearing and heavy damage can be prevented. Further stumbling on the stairs can be prevented.

Since the edge bead cushion 13, 23, 41 is located at the front edge of the tread mat 12, 22, a person can safely tread on the step without slipping. The edge bead cushion 13, 23, 41 is distinguishable, preventing one from missing his or her footing on the stairs. Further, since the edge bead cushion 13, 23, 41 has flexibility, even if a person misses the footing on the stairs through carelessness and bumps on the most dangerous nosing of the stairs, the impact is absorbed by the edge bead cushion 13, 23, 41, so as to prevent serious injury.

Further because the edge bead cushion 13, 23, 41 is located at the front edge of the tread mat 12, 22 which is frequently stepped on, the wearing out and the damage of the front edge of the tread mat 12, 22 can be reduced.

While several preferred embodiments of the invention have been shown and described in detail, it will be understood that these are for illustration purposes only and are not to be taken as a restriction of the invention.

What is claimed is:

1. A stair mat comprising:

an edge cover being formed of flexible synthetic resin, including an edge bead cushion having a hollow portion therein extended along the length of the edge bead cushion and a non-skid surface portion as serrations along the cross-section on the upper surface thereof, said edge cover being adapted to be secured to the forward edge of a step;

an edge base integrally set on the under surface of the edge bead cushion formed of synthetic resin having greater rigidity than that of the edge bead cushion and adapted to be formed on the edge of a step;

a tread side fixing tongue integrally and horizontally extended from the rear edge of the edge base formed of a synthetic resin having greater rigidity than that of the edge bead cushion and adapted to be secured to the tread of a step;

a riser side fixing tongue integrally and downwardly extended from the front edge of the edge base formed of a synthetic resin having greater rigidity than that of the edge bead cushion and adapted to be secured to the riser of a step; and a tread mat of carpet being fixed on the tread side fixing tongue, and adapted to be secured on the tread of a step.

2. A stair mat as claimed in claim 1, in which the edge bead cushion has a shield tongue integrally and downwardly extended from the front side of the edge bead cushion formed of a flexible resin and integrally fixed on the front surface of the riser side fixing tongue.

* * * * *